US009894453B2

(12) United States Patent
Doller

(10) Patent No.: US 9,894,453 B2
(45) **Date of Patent: *Feb. 13, 2018**

(54) ABSOLUTE SENSITIVITY OF A MEMS MICROPHONE WITH CAPACITIVE AND PIEZOELECTRIC ELECTRODES

(71) Applicant: Robert Bosch GmbH, Stuttgart (DE)

(72) Inventor: Andrew Doller, Sharpsburg, PA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/589,340

(22) Filed: May 8, 2017

(65) Prior Publication Data

US 2017/0245077 A1 Aug. 24, 2017

Related U.S. Application Data

(63) Continuation of application No. 14/970,175, filed on Dec. 15, 2015, now Pat. No. 9,648,433.

(51) Int. Cl.
*H04R 29/00* (2006.01)
*H04R 17/02* (2006.01)
(Continued)

(52) U.S. Cl.
CPC ..... *H04R 29/004* (2013.01); *H04R 17/02* (2013.01); *H04R 23/006* (2013.01); *H04R 23/02* (2013.01); *H04R 2201/003* (2013.01)

(58) Field of Classification Search
CPC ..... H04R 29/00; H04R 29/004; H04R 19/04; H04R 19/005; H04R 31/00; H04R 1/04;
(Continued)

(56) References Cited

U.S. PATENT DOCUMENTS 8,531,088 B2 9/2013 Grosh et al.
8,565,452 B2 10/2013 Coronato
(Continued)

FOREIGN PATENT DOCUMENTS

WO 2015/002821 1/2015

OTHER PUBLICATIONS

International Search Report for Application No. PCT/EP2016/076802 dated Jan. 27, 2017 (5 pages).

*Primary Examiner* — Thang Tran
(74) *Attorney, Agent, or Firm* — Michael Best & Friedrich LLP

(57) ABSTRACT

Microphone systems and methods of determining absolute sensitivities of a MEMS microphone. The microphone system includes a speaker, a MEMS microphone, and a controller. The speaker is configured to generate an acoustic pressure. The MEMS microphone includes a capacitive electrode, a piezoelectric electrode, and a backplate. The capacitive electrode is configured to generate a first capacitive response based on the acoustic pressure and generate a first mechanical pressure based on a capacitive control signal. The piezoelectric electrode is coupled to the capacitive electrode. The piezoelectric electrode is configured to generate a first piezoelectric response signal based on the acoustic pressure and generate a second piezoelectric response signal based on the first mechanical pressure. The controller is configured to generate the capacitive control signal and determine an absolute sensitivity of the capacitive electrode based on the first capacitive response, the first piezoelectric response signal, and the second piezoelectric response signal.

17 Claims, 6 Drawing Sheets

(51) Int. Cl.
*H04R 23/02* (2006.01)
*H04R 23/00* (2006.01)

(58) Field of Classification Search
CPC . H04R 7/24; H04R 3/00; H04R 3/007; H04R 17/00; H04R 17/02; H04R 23/02; H04R 23/006; B81B 2201/0257; B81B 2201/003; B81B 3/0018; B81B 3/0035; B81B 3/0072
See application file for complete search history.

(56) References Cited

U.S. PATENT DOCUMENTS

| | | | | |
|---|---|---|---|---|
| 8,831,246 | B2 | 9/2014 | Josefsson | |
| 8,884,150 | B2 | 11/2014 | Swanson | |
| 2007/0058825 | A1* | 3/2007 | Suzuki | H04R 19/04 381/174 |
| 2010/0246859 | A1 | 9/2010 | David | |
| 2011/0142261 | A1 | 6/2011 | Josefsson | |
| 2012/0250909 | A1 | 10/2012 | Grosh et al. | |
| 2013/0195288 | A1 | 8/2013 | Ye | |
| 2014/0169585 | A1 | 6/2014 | Howes | |
| 2014/0339657 | A1 | 11/2014 | Grosh et al. | |
| 2015/0010157 | A1 | 1/2015 | Doller | |
| 2015/0030164 | A1 | 1/2015 | Ranieri et al. | |
| 2015/0043747 | A1 | 2/2015 | Barham | |
| 2016/0088401 | A1* | 3/2016 | Yoo | H04R 31/00 381/173 |
| 2016/0127845 | A1 | 5/2016 | Cagdaser | |
| 2016/0142828 | A1* | 5/2016 | Yang | H04R 17/02 381/173 |
| 2016/0173992 | A1 | 6/2016 | Nicollini | |
| 2017/0070824 | A1* | 3/2017 | Hu | H04R 19/04 |

* cited by examiner

ABSOLUTE SENSITIVITY OF A MEMS MICROPHONE WITH CAPACITIVE AND PIEZOELECTRIC ELECTRODES

RELATED APPLICATIONS

This application is a continuation of U.S. patent application Ser. No. 14/970,175, entitled "ABSOLUTE SENSITIVITY OF A MEMS MICROPHONE WITH CAPACITIVE AND PIEZOELECTRIC ELECTRODES" filed Dec. 15, 2015, which is incorporated herein by reference in its entirety.

BACKGROUND

Embodiments of the disclosure relate to micro-electro-mechanical system (MEMS) microphones with both capacitive and piezoelectric electrodes.

The absolute sensitivity of an electrode in a MEMS microphone is the electrical response of the electrode's output to a given standard acoustic input. Allowable product variation of absolute sensitivities in MEMS microphones is, in general, decreasing. In addition, allowable testing time to determine the absolute sensitivities in MEMS microphones is also decreasing.

SUMMARY

Coupling a piezoelectric electrode to a capacitive electrode in a MEMS microphone adds a second reciprocal sensor which can be used to determine the absolute sensitivity.

One embodiment provides a microphone system. In one embodiment, the microphone system includes a speaker, a MEMS microphone, and a controller. The speaker is configured to generate an acoustic pressure. The MEMS microphone includes a capacitive electrode, a piezoelectric electrode, and a backplate. The capacitive electrode is configured to generate a first capacitive response based on the acoustic pressure. The capacitive electrode is also configured to generate a first mechanical pressure based on a capacitive control signal. The piezoelectric electrode is coupled to the capacitive electrode. The piezoelectric electrode is configured to generate a first piezoelectric response signal based on the acoustic pressure. The piezoelectric electrode is also configured to generate a second piezoelectric response signal based on the first mechanical pressure. The controller is configured to generate the capacitive control signal. The controller is also configured to determine an absolute sensitivity of the capacitive electrode based on the first capacitive response, the first piezoelectric response signal, and the second piezoelectric response signal.

Another embodiment provides a method of determining absolute sensitivities of a MEMS microphone. In one embodiment, the MEMS microphone includes a capacitive electrode, a piezoelectric electrode, and a backplate. The piezoelectric electrode is coupled to the capacitive electrode. The method includes generating acoustic pressure with a speaker. The method also includes generating a first capacitive response with the capacitive electrode based on the acoustic pressure. The method further includes generating a first piezoelectric response with the piezoelectric electrode based on the acoustic pressure. The method also includes generating a capacitive control signal with a controller. The method further includes generating a first mechanical pressure with the capacitive electrode based on the capacitive control signal. The method also includes generating a second piezoelectric response with the piezoelectric electrode based on the first mechanical pressure. The method further includes determining an absolute sensitivity of the capacitive electrode with the controller based in part on the first capacitive response, the first piezoelectric response, and the second piezoelectric response.

Yet another embodiment provides a microphone system. In one embodiment, the microphone system includes a speaker, a MEMS microphone, and a controller. The speaker is configured to generate an acoustic pressure. The MEMS microphone includes movable membrane and a backplate. The movable membrane includes a capacitive electrode and a piezoelectric electrode. The capacitive electrode is configured to generate a first capacitive response based on the acoustic pressure. The capacitive electrode is also configured to generate a first mechanical pressure based on a capacitive control signal. The piezoelectric electrode is configured to generate a first piezoelectric response signal based on the acoustic pressure. The piezoelectric electrode is also configured to generate a second piezoelectric response signal based on the first mechanical pressure. The backplate is positioned on the capacitive electrode. The controller is configured to generate the capacitive control signal. The controller is also configured to determine an absolute sensitivity of the capacitive electrode based on the first capacitive response, the first piezoelectric response signal, and the second piezoelectric response signal.

Still another embodiment provides a microphone system. In one embodiment, the microphone system includes a speaker, a MEMS microphone, and a controller. The speaker is configured to generate an acoustic pressure based on a speaker control signal. The MEMS microphone includes a capacitive electrode, a backplate, and a piezoelectric electrode. The capacitive electrode is configured such that the acoustic pressure causes a first movement of the capacitive electrode. The capacitive electrode is also configured to generate a first mechanical pressure based on a capacitive control signal. The backplate is positioned on a first side of the capacitive electrode. The piezoelectric electrode is coupled to the capacitive electrode. The piezoelectric electrode is configured to generate a first piezoelectric response signal based on the acoustic pressure. The piezoelectric electrode is further configured to generate a second piezoelectric response signal based on the first mechanical pressure. The controller is coupled to the speaker, the capacitive electrode, the backplate, and the piezoelectric electrode. The controller is configured to generate the speaker control signal. The controller is also configured to determine a first capacitive response based on the first movement of the capacitive electrode. The controller is further configured to generate the capacitive control signal. The controller is also configured to determine an absolute sensitivity of the capacitive electrode based on the first capacitive response, the first piezoelectric response signal, and the second piezoelectric response signal.

Another embodiment provides a method of determining absolute sensitivities of a MEMS microphone. In one embodiment, the MEMS microphone includes a capacitive electrode, a backplate, and a piezoelectric electrode. The piezoelectric electrode is coupled to the capacitive electrode. The method includes generating, by a speaker, an acoustic pressure based on a speaker control signal. The method further includes determining, by a controller, a first capacitive response of the capacitive electrode in response to the acoustic pressure. The method also includes determining, by the controller, a first piezoelectric response of the piezoelectric electrode in response to the acoustic pressure. The method further includes, generating, by the capacitive electrode, a first mechanical pressure based on a capacitive control signal. The method also includes determining, by the controller, a second piezoelectric response of the piezoelectric electrode in response to the first mechanical pressure. The method further includes determining, by the controller, an absolute sensitivity of the capacitive electrode based on the first capacitive response, the first piezoelectric response, and the second piezoelectric response.

Yet another embodiment provides a microphone system. In one embodiment, the microphone system includes a speaker, a MEMS microphone, and a controller. The speaker is configured to generate an acoustic pressure based on a speaker control signal. The MEMS microphone includes a movable membrane and a backplate. The movable membrane includes a piezoelectric electrode and a capacitive electrode. The capacitive electrode is configured such that the acoustic pressure causes a first movement of the capacitive electrode. The capacitive electrode is also configured to generate a first mechanical pressure based on a capacitive control signal. The piezoelectric electrode is configured to generate a first piezoelectric response signal based on the acoustic pressure. The piezoelectric electrode is further configured to generate a second piezoelectric response signal based on the first mechanical pressure. The backplate is positioned on the capacitive electrode. The controller is coupled to the speaker, the capacitive electrode, the backplate, and the piezoelectric electrode. The controller is configured to generate the speaker control signal. The controller is also configured to determine a first capacitive response based on the first movement of the capacitive electrode. The controller is further configured to generate the capacitive control signal. The controller is also configured to determine an absolute sensitivity of the capacitive electrode based on the first capacitive response, the first piezoelectric response signal, and the second piezoelectric response signal.

Other aspects of the disclosure will become apparent by consideration of the detailed description and accompanying drawings.

DETAILED DESCRIPTION

Figure 1:
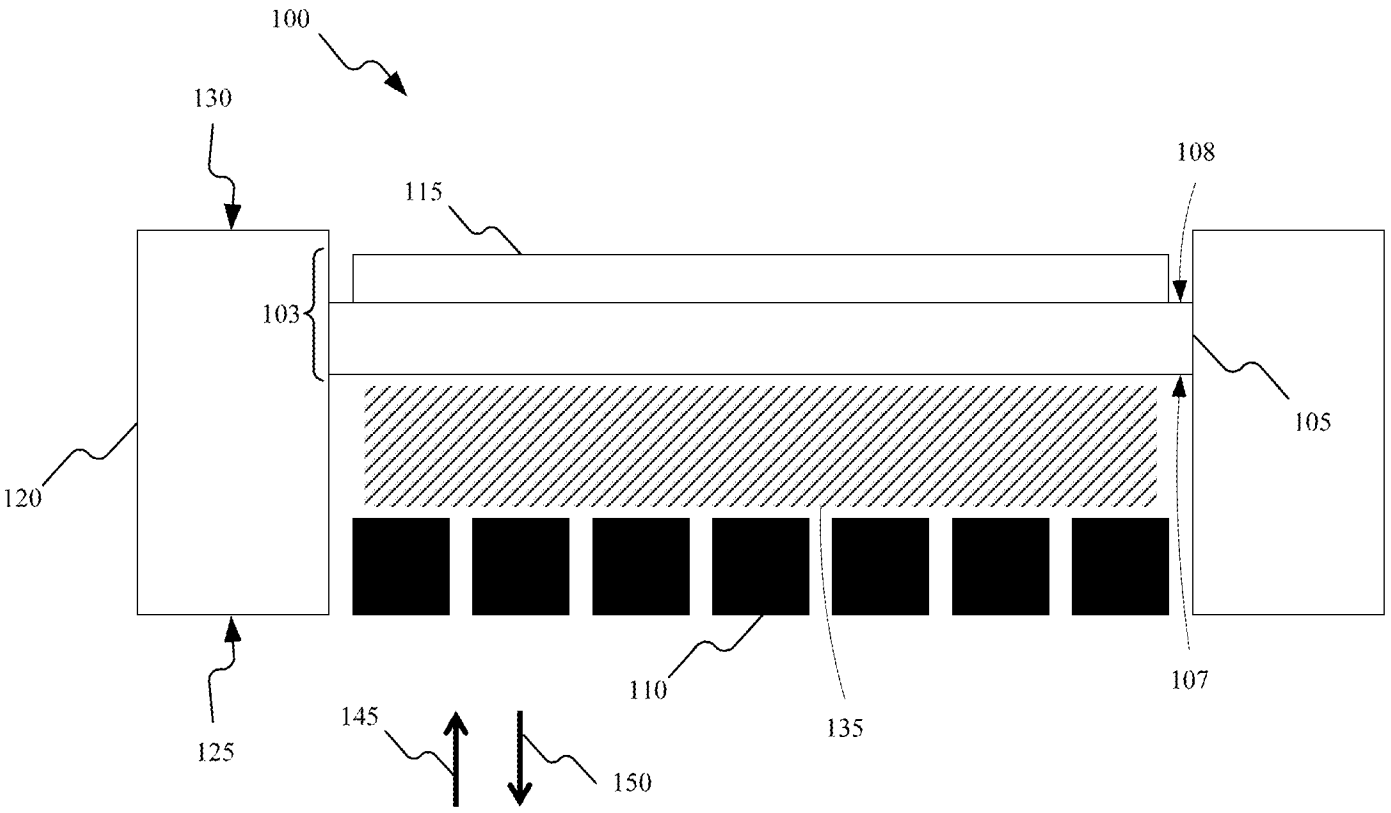
FIG. 1 is a cross-sectional view of a MEMS microphone, in accordance with some embodiments.

Before any embodiments of the invention are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using other known means including direct connections, wireless connections, etc. In addition, the terms "positive" and "negative" are used to distinguish one entity or action from another entity or action without necessarily requiring or implying any such attribute of the entity or action.

It should also be noted that a plurality of hardware and software based devices, as well as a plurality of other structural components may be utilized to implement the disclosure. Furthermore, and as described in subsequent paragraphs, the specific configurations illustrated in the drawings are intended to exemplify embodiments of the disclosure. Alternative configurations are possible.

In some embodiments, a MEMS microphone 100 includes, among other components, a movable membrane 103. In the example illustrated, the movable membrane 103 includes a capacitive electrode 105 having a first side 107 and a second side 108. The capacitive electrode 105 is also a movable membrane. The movable membrane 103 also includes a piezoelectric electrode 115. A fixed member (i.e., a backplate 110) and a barrier 120 are provided in the MEMS microphone 100. The second side 108 of the capacitive electrode 105 is opposite from the first side 107 of the capacitive electrode 105. In some embodiments, the backplate 110 is positioned on the first side 107 of the capacitive electrode 105, as illustrated in FIGS. 1-4. In other embodiments, the backplate 110 is positioned on the second side 108 of the capacitive electrode 105. The barrier 120 isolates a first side 125 and a second side 130 of the MEMS microphone 100.

Figure 2:
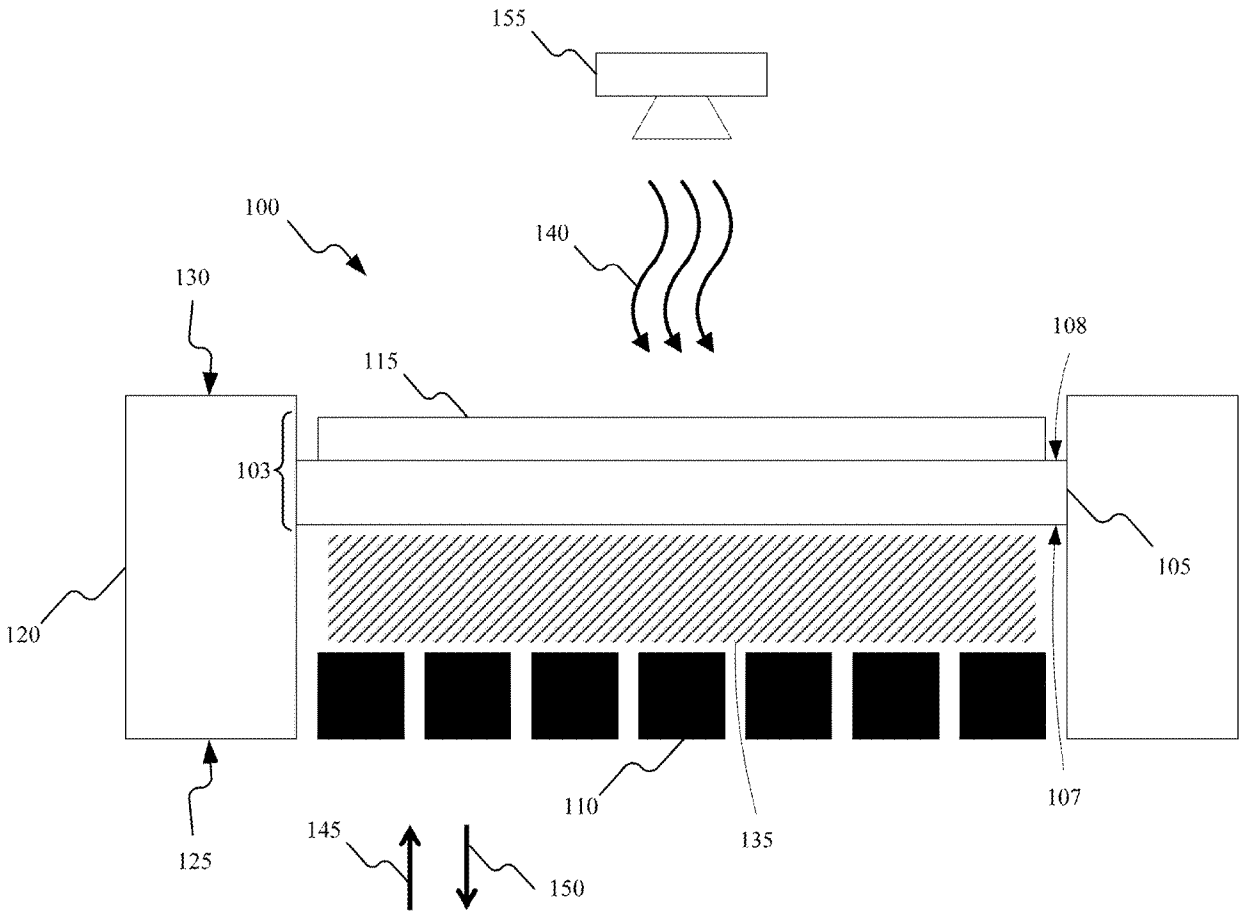
FIG. 2 is a cross-sectional view of a MEMS microphone and a speaker, in accordance with some embodiments.

In some embodiments, the capacitive electrode 105 is kept at a reference voltage and a bias voltage is applied to the backplate 110 to generate an electric sense field 135 between the capacitive electrode 105 and the backplate 110. In other embodiments, the backplate 110 is kept at a reference voltage and a bias voltage is applied to the capacitive electrode 105 to generate the electric sense field 135 between the capacitive electrode 105 and the backplate 110. In some embodiments, the reference voltage is a ground reference voltage (i.e., approximately 0 Volts). In other embodiments, the reference voltage is a non-zero voltage. The electric sense field 135 is illustrated in FIGS. 1 and 2 as a plurality of diagonal lines. Deflection of the capacitive electrode 105 in the directions of arrow 145 and 150 modulates the electric sense field 135 between the capacitive electrode 105 and the backplate 110. A voltage difference between the capacitive electrode 105 and the backplate 110 varies based on the electric sense field 135.

As illustrated in FIG. 2, acoustic pressure 140 acting on the second side 108 of the capacitive electrode 105 causes a first movement (e.g., deflection) of the capacitive electrode 105 in the direction of arrow 150. The acoustic pressure 140 is illustrated in FIG. 2 as a plurality of wavy arrows in the direction of arrow 150. The acoustic pressure 140 is generated by a transducer 155. The transducer 155 may be a receiver, a speaker, and the like. Although one speaker is illustrated, more than one speaker may be used, depending on the application. The transducer 155 generates the acoustic pressure 140 based on a received speaker control signal. The first movement of the capacitive electrode 105 modulates the electric sense field 135 between the capacitive electrode 105 and the backplate 110. A first voltage difference between the capacitive electrode 105 and the backplate 110 varies based on the first movement of the capacitive electrode 105.

Figure 3:
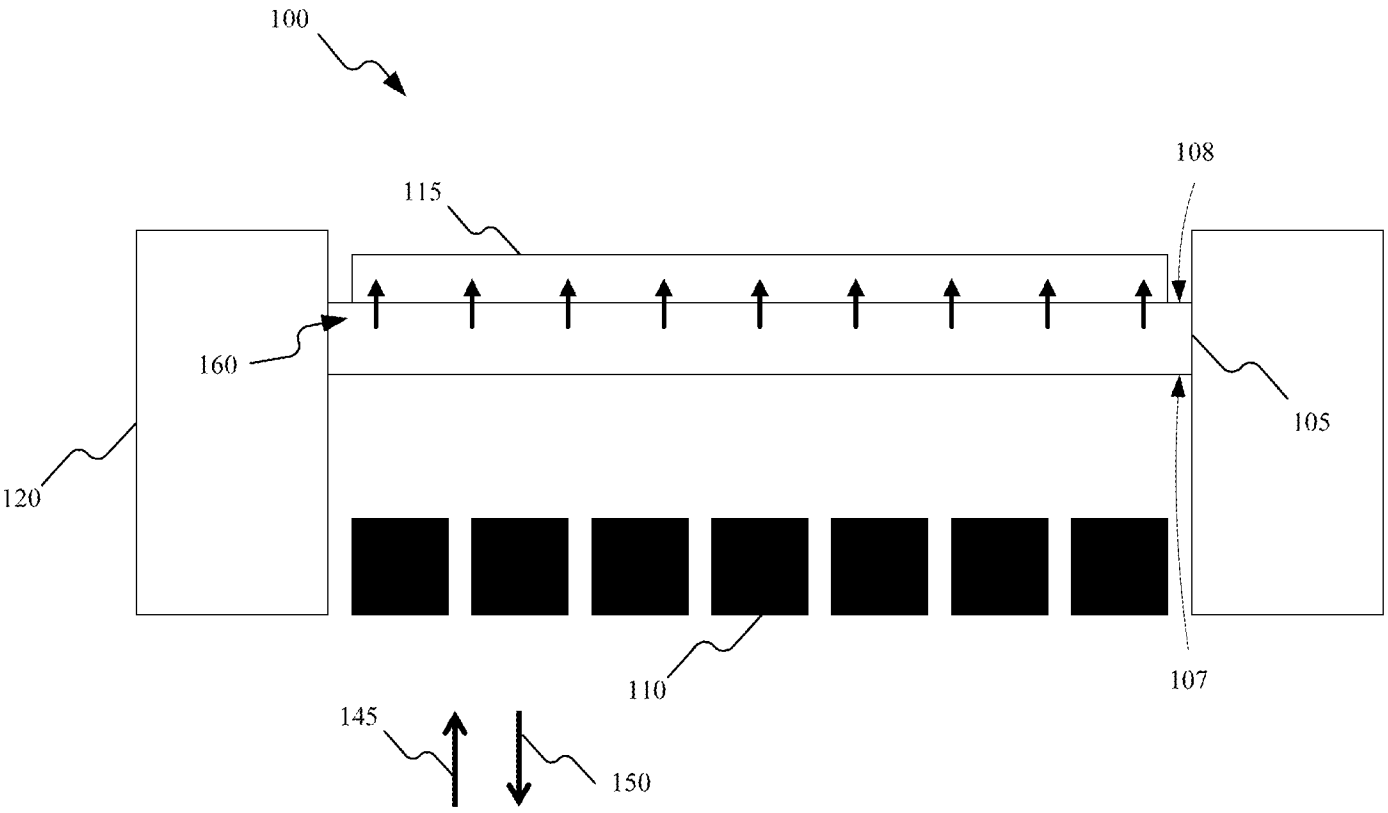
FIG. 3 is a cross-sectional view of a MEMS microphone, in accordance with some embodiments.

In some embodiments, a capacitive control signal is applied to the capacitive electrode 105. The capacitive control signal causes the capacitive electrode 105 to generate a first mechanical pressure 160, as illustrated in FIG. 3. The first mechanical pressure 160 is illustrated in FIG. 3 as a plurality of straight arrows in the direction of arrow 145. In some embodiments, the capacitive control signal is a current signal.

In one embodiment, the piezoelectric electrode 115 is a layer or material that uses the piezoelectric effect to measure changes in pressure or force by converting them to an electrical charge. In some embodiments, the piezoelectric electrode 115 includes aluminum nitride (AlN). In other embodiments, the piezoelectric electrode 115 includes zinc oxide (ZnO). In other embodiments, the piezoelectric electrode 115 includes lead zirconate titanate (PZT). The piezoelectric electrode 115 generates piezoelectric response signals in response to pressure (e.g., acoustic, mechanical) being applied to the piezoelectric electrode 115. In some embodiments, the piezoelectric electrode 115 is formed on the capacitive electrode 105 by a suitable deposition technique (e.g., atomic layer deposition), and defines a fabricated piezoelectric membrane.

The piezoelectric electrode 115 is coupled to the capacitive electrode 105. In some embodiments, the piezoelectric electrode 115 is coupled to the second side 108 of the capacitive electrode 105, as illustrated in FIGS. 1-4. In other embodiments, the piezoelectric electrode 115 is coupled to the first side 107 of the capacitive electrode 105. In some embodiments, the piezoelectric electrode 115 is formed on either side of the capacitive electrode 105 by a deposition technique.

The piezoelectric electrode 115 is configured to receive the acoustic pressure 140. The piezoelectric electrode 115 generates a first piezoelectric response signal in response to the acoustic pressure 140. The piezoelectric electrode 115 generates a second piezoelectric response signal in response to the first mechanical pressure 160 exerted by the capacitive electrode 105. In some embodiments, the first and second piezoelectric response signals are voltage signals.

Figure 4:
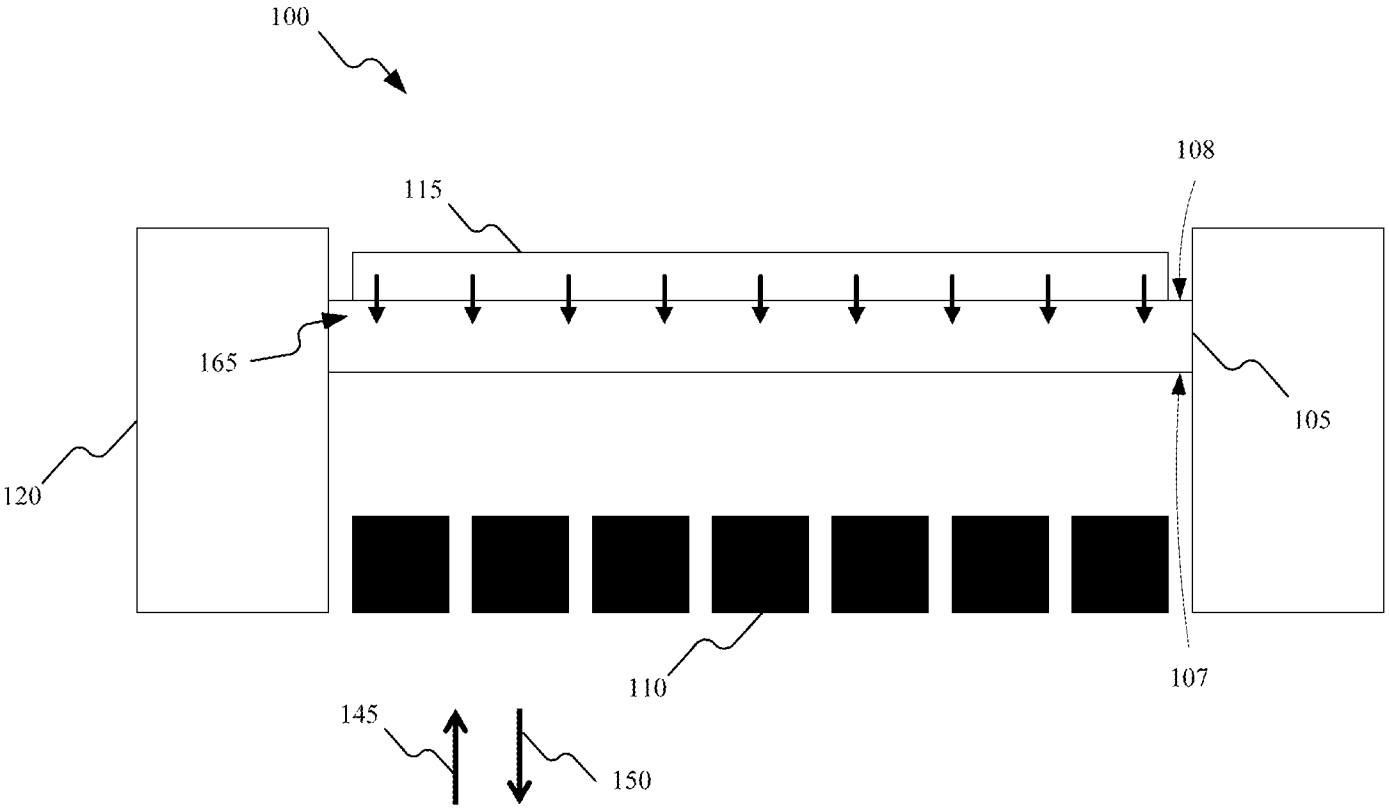
FIG. 4 is a cross-sectional view of a MEMS microphone, in accordance with some embodiments.

In some embodiments, a piezoelectric control signal is applied to the piezoelectric electrode 115. The piezoelectric control signal causes a shape of the piezoelectric electrode 115 to change. The shape change results in the piezoelectric electrode 115 generating a second mechanical pressure 165, as illustrated in FIG. 4. The second mechanical pressure 165 is illustrated in FIG. 4 as a plurality of straight arrows in the direction of arrow 150. In some embodiments, the piezoelectric control signal is a current signal.

The second mechanical pressure 165 generated by the shape change of the piezoelectric electrode 115 in turn causes a second movement of the capacitive electrode 105. Similar to the first movement, the second movement of the capacitive electrode 105 modulates the electric sense field 135 between the capacitive electrode 105 and the backplate 110. A second voltage difference between the capacitive electrode 105 and the backplate 110 varies based on the second movement of the capacitive electrode 105.

In some embodiments, the piezoelectric material is deposited on the second side 108 of the movable membrane so as to form the piezoelectric electrode 115. The first side 107 of the movable membrane defines the capacitive electrode 105. The piezoelectric electrode 115 generates the first response signal in response to the acoustic pressure 140. The piezoelectric electrode 115 generates the second piezoelectric signal in response to the first mechanical pressure 160 exerted by the capacitive electrode 105. The second mechanical pressure 165 generated by the shape change of the piezoelectric electrode 115, in turn, causes a second movement of the capacitive electrode 105. Similar to the first movement, the second movement of the capacitive electrode 105 modulates the electric sense field 135 between the capacitive electrode 105 and the backplate 110. A second voltage difference between the capacitive electrode 105 and the backplate 110 varies based on the second movement of the capacitive electrode 105.

Figure 5:
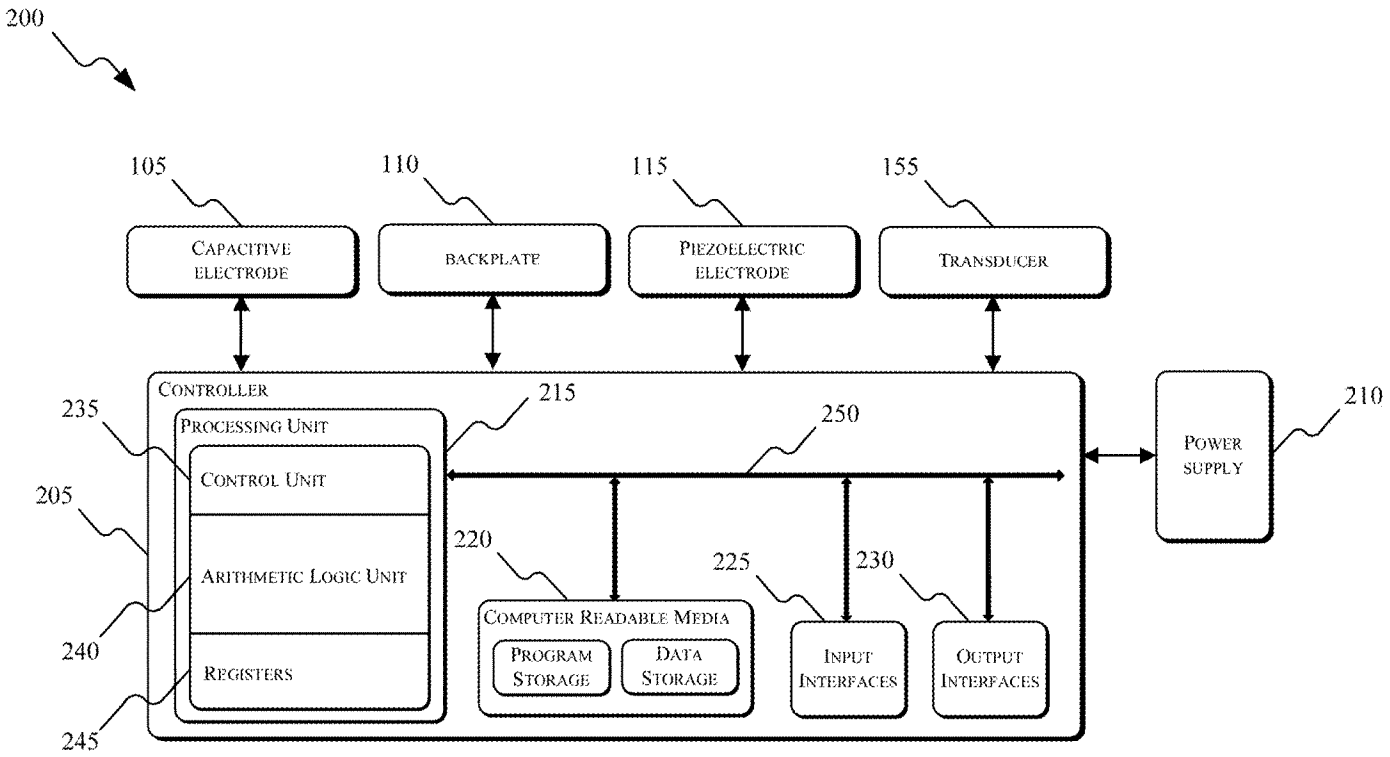
FIG. 5 is a schematic diagram of a microphone system, in accordance with some embodiments.

In some embodiments, a microphone system 200 includes, among other components, the MEMS microphone 100, the transducer 155, a controller 205, and a power supply 210, as illustrated in FIG. 5.

In some embodiments, the controller 205 includes a plurality of electrical and electronic components that provide power, operational control, and protection to the components and modules within the controller 205, the MEMS microphone 100, the transducer 155, and/or the microphone system 200. For example, the controller 205 includes, among other components, a processing unit 215 (e.g., a microprocessor, a microcontroller, or another suitable programmable device), a memory or computer readable media 220, input interfaces 225, and output interfaces 230. The processing unit 215 includes, among other components, a control unit 235, an arithmetic logic unit (ALU) 240, and a plurality of registers 245 (shown as a group of registers in FIG. 5), and is implemented using a known computer architecture, such as a modified Harvard architecture, a von Neumann architecture, etc. The processing unit 215, the computer readable media 220, the input interfaces 225, and the output interfaces 230, as well as the various modules connected to the controller 205 are connected by one or more control and/or data buses (e.g., common bus 250). The control and/or data buses are shown generally in FIG. 5 for illustrative purposes. The use of one or more control and/or data buses for the interconnection between and communication among the various modules and components would be known to a person skilled in the art in view of the invention described herein. In some embodiments, the controller 205 is implemented partially or entirely on a semiconductor chip, is a field-programmable gate array (FPGA), is an application specific integrated circuit (ASIC), or is a similar device.

The computer readable media 220 includes, for example, a program storage area and a data storage area. The program storage area and the data storage area can include combinations of different types of memory, such as read-only memory (ROM), random access memory (RAM) (e.g., dynamic RAM [DRAM], synchronous DRAM [SDRAM], etc.), electrically erasable programmable read-only memory (EEPROM), flash memory, a hard disk, an SD card, or other suitable magnetic, optical, physical, or electronic memory devices or data structures. The processing unit 215 is connected to the computer readable media 220 and executes software instructions that are capable of being stored in a RAM of the computer readable media 220 (e.g., during execution), a ROM of the computer readable media 220 (e.g., on a generally permanent basis), or another nontransitory computer readable medium such as another memory or a disc. Software included in some embodiments of the microphone system 200 can be stored in the computer readable media 220 of the controller 205. The software includes, for example, firmware, one or more applications, program data, filters, rules, one or more program modules, and other executable instructions. The controller 205 is configured to retrieve from memory and execute, among other things, instructions related to the control processes and methods described herein. In other constructions, the controller 205 includes additional, fewer, or different components.

The controller 205 is coupled to the capacitive electrode 105 and the backplate 110. As described herein, the acoustic pressure 140 generated by the transducer 155 causes the first movement of the capacitive electrode 105. The controller 205 determines a first capacitive response of the capacitive electrode 105 in response to the acoustic pressure 140 being applied. The first capacitive response is based on the first movement of the capacitive electrode 105. In some embodiments, the controller 205 determines the first voltage difference between the capacitive electrode 105 and the backplate 110 caused by the first movement of the capacitive electrode 105. Further, the controller 205 determines the first capacitive response based on the first voltage difference.

Also, as described herein, the second mechanical pressure 165, generated by the piezoelectric electrode 115, causes a second movement of the capacitive electrode 105. The controller 205 determines a second capacitive response of the capacitive electrode 105 in response to the second mechanical pressure 165 being applied. The second capacitive response is based on the second movement of the capacitive electrode 105. In some embodiments, the controller 205 determines the second voltage difference between the capacitive electrode 105 and the backplate 110 caused by the second movement of the capacitive electrode 105. Further, the controller 205 determines the second capacitive response based on the second voltage difference. The controller 205 also generates and applies the capacitive control signal to the capacitive electrode 105.

The controller 205 is also coupled to the piezoelectric electrode 115. The controller 205 receives the first and second piezoelectric response signals generated by the piezoelectric electrode 115. In some embodiments, the controller 205 generates and applies the piezoelectric control signal to the piezoelectric electrode 115.

The controller 205 is further coupled to the transducer 155. The controller 205 generates and applies the speaker control signal to the transducer 155.

The power supply 210 supplies a nominal AC or DC voltage to the controller 205 and/or other components of the microphone system 200. The power supply 210 is powered by one or more batteries or battery packs. The power supply 210 is also configured to supply lower voltages to operate circuits and components within the microphone system 200. In some embodiments, the power supply 210 generates, among other things, the speaker control signal, the piezoelectric control signal, and the capacitive control signal. In some embodiments, the power supply 210 is powered by mains power having nominal line voltages between, for example, 100V and 240V AC and frequencies of approximately 50-60 Hz.

In one embodiment, the controller 205 determines absolute sensitivities of the capacitive electrode 105 and the piezoelectric electrode 115 using a reciprocity technique. The reciprocity technique includes a plurality of measurements. A first measurement includes the controller 205 applying the speaker control signal to the transducer 155 and determining the first capacitive response of the capacitive electrode 105. A second measurement includes the controller 205 applying the speaker control signal to the transducer 155 and determining the first piezoelectric response (e.g., the first piezoelectric response signal) of the piezoelectric electrode 115. A third measurement includes the controller 205 applying a capacitive control signal to the capacitive electrode 105 and determining the second piezoelectric response (e.g., the second piezoelectric response signal) of the piezoelectric electrode 115. In some embodiments, a fourth measurement includes the controller 205 applying the piezoelectric control signal to the piezoelectric electrode 115 and determining the second capacitive response of the capacitive electrode 105.

The first and second measurements can be used with the following equations:

$$V_{C1}=M_C\times P_S \tag{1}$$

wherein, $V_{C1}$=first capacitive response of the capacitive electrode 105, $M_C$=absolute sensitivity of the capacitive electrode 105, and $P_S$=acoustic pressure 140 applied to the capacitive electrode 105 by the transducer 155 in response to the speaker control signal.

$$V_{P1}=M_P\times P_S \tag{2}$$

wherein, $V_{P1}$=first piezoelectric response of the piezoelectric electrode 115, $M_P$=absolute sensitivity of the piezoelectric electrode 115, and $P_S$=acoustic pressure 140 applied to the piezoelectric electrode 115 by the transducer 155 in response to the speaker control signal.

The same amount of acoustic pressure 140 is applied by the transducer 155 to the capacitive electrode 105 and the piezoelectric electrode 115. Therefore, equations 1 and 2 can be combined to form the follow equation:

$$M_P=M_C\times(V_{P1}/V_{C1}) \tag{3}$$

The third measurement can be used with following equation:

$$M_P\times M_O=(1/Z_M)\times(V_{P2}/I_C) \tag{4}$$

wherein, $Z_M$=mechanical transfer impedance, $V_{P2}$=second piezoelectric response of the piezoelectric electrode 115, and $I_C$=capacitive control signal.

The mechanical transfer impedance is a system variable that is determined based on the construction on the MEMS microphone 100. In some embodiments, the mechanical transfer impedance is substantially equal to one.

Equations 3 and 4 can be combined to form the following equation to determine the absolute sensitivity of the capacitive electrode 105:

$$(M_C)^2=(V_{C1}/V_{P1})\times(1/Z_M)\times(V_{P2}/I_C) \tag{5}$$

The fourth measurement can be used with the following equation:

$$M_P\times M_O=(1/Z_M)\times(V_{C2}/I_P) \tag{6}$$

wherein, $V_{C2}$=second capacitive response of the capacitive electrode 105, and $I_P$=piezoelectric control signal.

Equations 3 and 6 can be combined to form the following equation to determine the absolute sensitivity of the piezoelectric electrode 115:

$$(M_P)^2=(V_{P1}/V_{C1})\times(1/Z_M)\times(V_{C2}/I_P) \quad (7).$$

Figure 6:
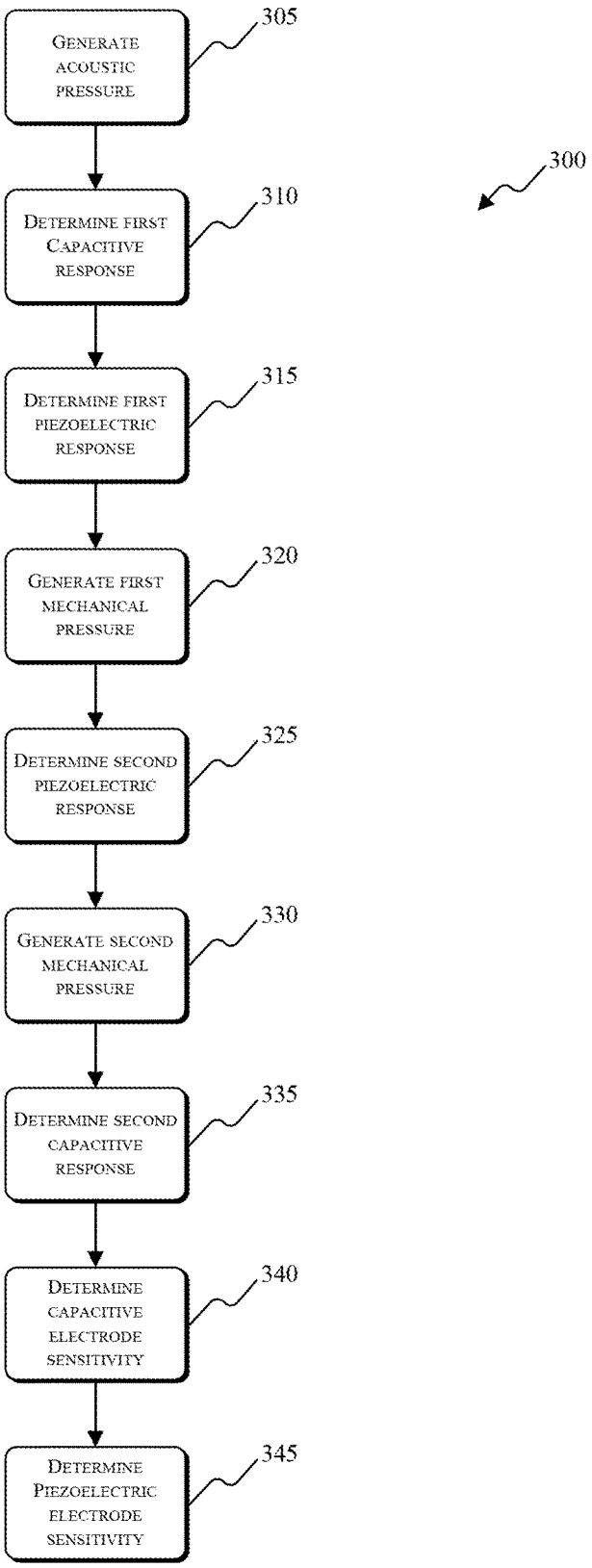
FIG. 6 is a flowchart of determining absolute sensitivities of a MEMS microphone, in accordance with some embodiments.

FIG. 6 illustrates a process 300 (or method) for determining the absolute sensitivities of the capacitive electrode 105 and the piezoelectric electrode 115. Various steps described herein with respect to the process 300 are capable of being executed simultaneously, in parallel, or in an order that differs from the illustrated serial manner of execution. The process 300 may also be capable of being executed using fewer steps than are shown in the illustrated embodiment. As will be explained in greater detail, portions of the process 300 can be implemented in software executed by the controller 205.

The process 300 begins with the generation of acoustic pressure 140 by the transducer 155 (step 305). In some embodiments, the transducer 155 generates the acoustic pressure 140 in response to receiving the speaker control signal from the controller 205. The controller 205 determines the first capacitive response of the capacitive electrode 105 in response to the acoustic pressure 140 (step 310). The controller 205 also determines the first piezoelectric response of the piezoelectric electrode 115 in response to the acoustic pressure 140 (step 315).

Next, the capacitive electrode 105 generates the first mechanical pressure 160 (step 320). In some embodiments, the capacitive electrode 105 generates the first mechanical pressure 160 in response to receiving the capacitive control signal. The controller 205 determines the second piezoelectric response of the piezoelectric electrode 115 in response to the first mechanical pressure 160 (step 325). Next, the piezoelectric electrode 115 generates the second mechanical pressure 165 (step 330). In some embodiments, the piezoelectric electrode 115 generates the second mechanical pressure 165 in response to receiving the piezoelectric control signal. The controller 205 determines the second capacitive response of the capacitive electrode 105 in response to the second mechanical pressure 165 (step 335).

At step 340, the controller 205 then determines the absolute sensitivity of the capacitive electrode 105. In some embodiments, the controller 205 determines the absolute sensitivity of the capacitive electrode 105 based on the first capacitive response, the first piezoelectric response, and the second piezoelectric response. In some embodiments, the controller 205 determines the absolute sensitivity of the capacitive electrode 105 according to equation 5, described herein. At step 345, the controller 205 determines the absolute sensitivity of the piezoelectric electrode 115. In some embodiments, the controller 205 determines the absolute sensitivity of the piezoelectric electrode 115 based on the first capacitive response, the second capacitive response, and the first piezoelectric response. In some embodiments, the controller 205 determines the absolute sensitivity of the piezoelectric electrode 115 according to equation 7, described herein.

Thus, the disclosure provides, among other things, microphone systems and methods of determining absolute sensitivities on a MEMS microphone. Various features and advantages of the disclosure are set forth in the following claims.

What is claimed is:

1. A microphone system comprising:

a speaker configured to generate acoustic pressure;

a micro-electro-mechanical system (MEMS) microphone including a capacitive electrode configured to generate a first capacitive response based on the acoustic pressure, and generate a first mechanical pressure based on a capacitive control signal, a piezoelectric electrode coupled to the capacitive electrode and configured to generate a first piezoelectric response signal based on the acoustic pressure, and generate a second piezoelectric response signal based on the first mechanical pressure, and a backplate positioned parallel to the capacitive electrode; and a controller configured to generate the capacitive control signal, and determine an absolute sensitivity of the capacitive electrode based on the first capacitive response, the first piezoelectric response signal, and the second piezoelectric response signal.

2. The microphone system according to claim 1, wherein the controller is further configured to generate a piezoelectric control signal, and wherein the piezoelectric electrode is further configured to generate a second mechanical pressure based on the piezoelectric control signal.

3. The microphone system according to claim 2, wherein the capacitive electrode is further configured to generate a second capacitive response based on the second mechanical pressure.

4. The microphone system according to claim 3, wherein the controller is further configured to determine an absolute sensitivity of the piezoelectric electrode based at least in part on the first capacitive response, the second capacitive response, and the first piezoelectric response signal.

5. The microphone system according to claim 1, wherein the controller is further configured to generate a speaker control signal, and wherein the speaker generates the acoustic pressure based on the speaker control signal.

6. The microphone system according to claim 1, wherein the backplate is positioned on a first side of the capacitive electrode, wherein the piezoelectric electrode is positioned on a second side of the capacitive electrode, and wherein the second side of the capacitive electrode is opposite from the first side of the capacitive electrode.

7. A method of determining absolute sensitivities of a micro-electro-mechanical system (MEMS) microphone, the MEMS microphone including a capacitive electrode, a piezoelectric electrode coupled to the capacitive electrode, and a backplate, the method comprising:

generating acoustic pressure with a speaker;

generating a first capacitive response with the capacitive electrode based on the acoustic pressure;

generating a first piezoelectric response with the piezoelectric electrode based on the acoustic pressure;

generating a capacitive control signal with a controller;

generating a first mechanical pressure with the capacitive electrode based on the capacitive control signal;

generating a second piezoelectric response with the piezoelectric electrode based on the first mechanical pressure; and determining an absolute sensitivity of the capacitive electrode with the controller based in part on the first capacitive response, the first piezoelectric response, and the second piezoelectric response.

8. The method according to claim 7, wherein the method further comprises generating a piezoelectric control signal with the controller; and generating a second mechanical pressure with the piezoelectric electrode based on the piezoelectric control signal.

9. The method according to claim 8, wherein the method further comprises generating a second capacitive response with the capacitive electrode based on the second mechanical pressure.

10. The method according to claim 9, wherein the method comprises determining an absolute sensitivity of the piezoelectric electrode with the controller based at least in part on the first capacitive response, the second capacitive response, and the first piezoelectric response.

11. The method according to claim 7, wherein the method further comprises generating a speaker control signal with the controller, and wherein the speaker generates the acoustic pressure based on the speaker control signal.

12. A microphone system comprising:

a speaker configured to generate an acoustic pressure;

a micro-electro-mechanical system (MEMS) microphone including a movable membrane having a capacitive electrode configured to generate a first capacitive response based on the acoustic pressure, and generate a first mechanical pressure based on a capacitive control signal, and a piezoelectric electrode configured to generate a first piezoelectric response signal based on the acoustic pressure, and generate a second piezoelectric response signal based on the first mechanical pressure, and a backplate positioned on the capacitive electrode; and a controller configured to generate the capacitive control signal, and determine an absolute sensitivity of the capacitive electrode based in part on the first capacitive response, the first piezoelectric response signal, and the second piezoelectric response signal.

13. The microphone system according to claim 12, wherein the controller is further configured to generate a piezoelectric control signal, and wherein the piezoelectric electrode is further configured to generate a second mechanical pressure based on the piezoelectric control signal.

14. The microphone system according to claim 13, wherein the capacitive electrode is further configured to generate a second capacitive response based on the second mechanical pressure.

15. The microphone system according to claim 14, wherein the controller is further configured to determine an absolute sensitivity of the piezoelectric electrode based in part on the first capacitive response, the second capacitive response, and the first piezoelectric response signal.

16. The microphone system according to claim 12, wherein the controller is further configured to generate a speaker control signal, and wherein the speaker generates the acoustic pressure based on the speaker control signal.

17. The microphone system according to claim 12, wherein the backplate is positioned on a first side of the capacitive electrode, wherein the piezoelectric electrode is positioned on a second side of the capacitive electrode, and wherein the second side of the capacitive electrode is opposite from the first side of the capacitive electrode.

* * * * *